US009345071B2

(12) United States Patent
Kästle et al.

(10) Patent No.: US 9,345,071 B2
(45) Date of Patent: May 17, 2016

(54) HEATING DEVICE

(71) Applicants: Behr GmbH & Co. KG, Stuttgart (DE); Behr France Rouffach SAS, Rouffach (FR)

(72) Inventors: Christoph Kästle, Stuttgart (DE); Michael Kohl, Bietigheim-Bissingen (DE); Peter Englert, Bad Friedrichshall (DE); Karl-Gerd Krumbach, Burgstetten (DE); Michel Brun, Rustenhart (FR); Jerome Stoeckel, Bollwiller (FR)

(73) Assignee: MAHLE International GmbH, Stuttgart (DE)

( * ) Notice: Subject to any disclaimer, the term of this patent is extended or adjusted under 35 U.S.C. 154(b) by 349 days.

(21) Appl. No.: 13/939,594

(22) Filed: Jul. 11, 2013

(65) Prior Publication Data

US 2014/0014645 A1 Jan. 16, 2014

(30) Foreign Application Priority Data

Jul. 11, 2012 (EP) ..... 12290232

(51) Int. Cl.

| | |
|---|---|
| ***H05B 3/06*** | (2006.01) |
| ***H05B 3/44*** | (2006.01) |
| ***H05B 3/24*** | (2006.01) |
| *F24H 3/04* | (2006.01) |

(52) U.S. Cl.

CPC .. *H05B 3/44* (2013.01); *H05B 3/24* (2013.01); *F24H 3/0429* (2013.01); *H05B 2203/02* (2013.01); *H05B 2203/023* (2013.01)

(58) Field of Classification Search

CPC ..... H05B 3/24; H05B 3/44; H05B 2203/02; H05B 2203/023; F24H 3/0429

See application file for complete search history.

(56) References Cited

U.S. PATENT DOCUMENTS 5,262,619 A 11/1993 Karner

FOREIGN PATENT DOCUMENTS

| | | | |
|---|---|---|---|
| DE | 197 37 241 A1 | | 4/1999 |
| DE | 19737241 | * | 4/1999 |
| DE | 10 2004 055 523 A1 | | 6/2005 |
| DE | 10 2006 025 320 A1 | | 12/2007 |
| DE | 20 2011 004 800 U1 | | 6/2011 |
| EP | 0 530 525 A1 | | 3/1993 |

OTHER PUBLICATIONS

European Search Report, Application No. 12290232.3-2214, Dec. 17, 2012, 6 pgs.

* cited by examiner

*Primary Examiner* — Shawntina Fuqua

(74) *Attorney, Agent, or Firm* — Paul D. Strain, Esq.; Strain & Strain PLLC

(57) ABSTRACT

An electrically operated heating device, in particular for a heating or air conditioning system of a vehicle, is provided, comprising a heating register with a layered heating element, for converting electrical energy into heat, and two electrically insulating and heat-conducting insulating layers, which respectively make contact, at least in certain regions, with one side of the layered heating element. The insulating layers and the layered heating element are braced with one another, an abrasion-counteracting sliding layer being arranged between at least one of the insulating layers and the layered heating element. Alternatively or in addition, at least one of the insulating layers and the layered heating element have, at least in the region of their mutual contact surfaces, a material pairing with which the abrasion of the contact surfaces goes below a predetermined limit value.

9 Claims, 4 Drawing Sheets

HEATING DEVICE

CROSS-REFERENCE TO RELATED PATENT APPLICATIONS

This application is based upon and claims the benefit of priority from prior European Patent Application No. EP12290232.3-1808, filed Jul. 11, 2012, the entire contents of which are incorporated herein by reference in their entirety.

TECHNICAL FIELD

The invention relates to a heating device, in particular for a heating or air conditioning system of a vehicle, according to the preamble of claim 1.

PRIOR ART

It is known from the prior art to install electrically operated heating devices in heat exchangers for heating and air conditioning systems of motor vehicles, where they are used for example as auxiliary heating. Such electrically operated heating devices that are used as auxiliary heating devices and comprise a number of layers of different materials are known from the documents DE 10 2004 055 523 A1 and DE 10 2006 025 320 A1.

In particular in hybrid vehicles or in entirely electrically operated vehicles, electrically operated heating devices are used for example as auxiliary heaters. In the case of such vehicles, the vehicle system voltage is greater than 60 V, sometimes even greater than 300 V. On account of the high required heating outputs of the heating devices or of the auxiliary heater, in such vehicles said heater is usually operated at high voltages in order to be able to keep the current as low as possible. A voltage drop would make it necessary to use higher currents. Such a heater that is designed for operation by means of a high voltage must also have reliable shock protection, allowing any risk to the occupants of the vehicle during operation to be eliminated. The requirement here is that all parts of the electric heater or auxiliary heater that are electrically conductive and externally exposed are potential-free, which means that absolute shock protection in accordance with protection class I or protection class II must be ensured.

Generally, in the known heating registers different materials are used for different layers, since they must also perform different tasks. The insulating layers must have good electrical insulation, a high breakdown strength and good thermal conductivity, for which insulating ceramics such as for example alumina can be used in particular. Furthermore, the contact electrodes must have very good thermal and electrical conductivity. The contact electrodes consist for example of aluminum or other materials. Such contact electrodes are only present if the heating register comprises a heating unit with a PTC layer. On the other hand, when a heating unit with thick-film heating elements is used, there are no contact electrodes that form a tribological system by surface contacting. Furthermore, an enveloping layer, which may be formed as a tube wall or as an aluminum profile, may have very good thermal conductivity.

A heater that is suitable for operation by means of a high voltage is known for example from an earlier patent application of the applicant, the heater described there being formed from a number of layers or elements of different materials, which are located in a closed compressed or pressed heating register profile and braced with one another. In this case, the elements may be braced with one another by means of a braced profiled tube or by way of a braced system, which may be formed inter alia from springs and/or clips.

An example of how the heating register of a conventional heater is constructed is described in more detail below in conjunction with the accompanying FIG. 1. The heating register 10 represented in FIG. 1 comprises a layered heating element 20, which comprises a PTC ceramic 30 with at least one conducting contact layer, which is adhesively bonded to contact sheets 40, for example by means of silicone. The conducting contact layer may be formed from gold. Furthermore, the layered heating unit 20 may comprise thick-film heating elements on a supporting material, which is for example formed from insulating ceramic. Furthermore, the heating register 10 comprises two insulating layers 50, which are formed for example from insulating ceramic, and an enveloping outer layer 60, for example of aluminum, which here comprises a tube profile and may be formed in particular as a compressed tube. The enveloping layer 60 is preferably formed as an extrusion profile (not represented). Furthermore, the contact regions between contacting layers are identified by the reference numeral 35.

Overall, it is important here that the layered heating element 20, the insulating layers 50 and the enveloping layer 60 are braced or compressed with one another. The pressing force ensures a good heat transfer from the heating unit 20 to the heat-transmitting surface, which may be a wall or a rib.

Furthermore, the insulating layers 50 must have good thermal conductivity and ensure the electrical separation between the heating unit, in particular the contact sheets of the heating unit, on the one hand and the enveloping outer layer 60 on the other hand. An insulating ceramic of alumina meets these two requirements. Altogether, the surroundings of the contact surfaces and the type, progression and extent of wear of the contact surfaces are determined by the materials and the nature of the components, as well as by intermediate substances, ambient influences and operating conditions.

On account of the mentioned different materials of adjacent layers, with in each case different or very different material properties, that are used in the heaters and come into contact with one another, there is relative movement and friction between the elements of the heater during operation. In particular, there are particularly material pairings with different coefficients of thermal expansion. Consequently, the different elements form a tribological system, which comprises the surfaces of at least two components that are in moving contact with one another.

Generally, however, they have the effect that the relative movement and friction between the elements of the heater that occur during operation lead to abrasion (fretting) of the contact surfaces of the elements and, as a result of this, finally to a loss of power because of the air gaps occurring as a result between the contact surfaces of the elements. The heat produced in the core of the heating register, that is to say for example between two contact electrodes, must be dissipated to the surroundings by way of the insulating ceramic and the enveloping tube, which results in a drop in power during the operation of the heater if air gaps are present.

In particular in the case of material pairings such as for example soft aluminum in direct contact with very hard insulating ceramic, the mentioned gap-forming abrasion, for example of the aluminum, can occur, as for example in the case of a contact sheet of aluminum, an interposed insulating layer of alumina and an enveloping outer layer, formed as a tube or as a profile of extruded aluminum.

In FIGS. 2 and 3, a greatly schematized partial cross-sectional view through the heating register 10 from FIG. 1 is respectively presented, FIG. 2 showing a new heating register 10, that is to say a heater in an initial state directly after its production, whereas the heating register 10 in a state after it has gone through a number of thermal cycles is shown in FIG. 3.

The layered structure of the heating register 10 can be clearly seen from FIGS. 2 and 3: the PTC layer 30 is adhesively bonded to a contact electrode 40 by means of an adhesive 21. On its side facing away from the PTC layer 30, the contact electrode 40 represented contacts an insulating layer 50. Between the contact electrode 40 and the insulating layer 50 there is an air gap 41. Furthermore, on its side facing away from the contact electrode 40, the insulating layer 50 contacts the enveloping outer layer (tube wall) 60. Between the insulating layer 50 and the enveloping outer layer 60 there is a further air gap 51. The tube wall 60 is adhesively bonded to a rib 70, through which air 80 flows, by means of an adhesive 61.

It can be established from a comparison of the illustrations shown in FIGS. 2 and 3 that the air gap 41 between the contact sheet 40 and the insulating layer 50 and the air gap 51 between the insulating layer 50 and the tube wall 60 have in each case become much larger because of the abrasion existing between the respective contacting layers 40 and 50, and 50 and 60.

In FIG. 4, the variation of a temperature T caused by the PTC layer 20 in dependence on a heat transmission distance d between the PTC layer 30 and the tube wall 60 is represented. The temperature dependence of the new heating register 10 (compare FIG. 2) is denoted here by KT1 and the corresponding temperature dependence for the same heating register 10 in a state after it has gone through a number of thermal cycles (compare FIG. 3) is denoted here by KT2. Furthermore, the temperature difference that is caused by the loss of power in the heating register 10 due to abrasion and the resultant increase in the size of the air gaps 41 and 51 is identified by ΔT.

The greater or longer the individual heating registers or heating sections are, the greater the absolute thermal expansion and the associated frictional path between the individual layers also become. The choice of a suitable tribological system is therefore unavoidable to prevent the occurrence of air gaps between the layers that lead to a poor heat yield, even air gaps with a thickness of less than 100 μm being capable of leading to a loss of power of over 30%.

SUMMARY OF THE INVENTION, PROBLEM, SOLUTION, ADVANTAGES

The invention addresses the problem of providing a heating device of which the heating register is formed in such a way as to minimize the abrasion between the layers forming the heating register that occurs in particular on account of the different thermal expansions of the different material pairings that are used for these layers.

This is achieved by the features of claim 1, according to which an electrically operated heating device has a heating register, which comprises a layered heating element, for converting electrical energy into heat, and at least one, preferably two, electrically insulating and heat-conducting insulating layer or insulating layers, which respectively make(s) contact, at least in certain regions, with one side of the layered heating element, the insulating layer and the layered heating element being braced with one another. Furthermore, an abrasion-counteracting sliding layer is arranged between at least one of the insulating layers and the layered heating element and/or at least one of the insulating layers and the layered heating element have, at least in the region of their mutual contact surfaces, a material pairing with which the abrasion of the contact surfaces goes below a predetermined limit value.

Further advantageous refinements are described by the following description of the figures and by the subclaims.

According to the invention, by contrast with the prior art, friction-optimized, lubricant-free material pairings that do not tend to fret are used for at least two contacting layers, in particular for the heating element in the region of its contact surfaces and for the insulating layers. In this way, the material pairings between at least two of the moving components or layers are advantageously made to match such that the abrasion is reduced or minimized. Thus, the material pairings can be chosen in such a way that the coefficient of friction between the contacting layers is reduced. Between the contacting layers, in particular between the contact surfaces of the heating element and the insulating layers, there may also be a sliding layer, by which the abrasion between the heating element and the insulating layers is reduced or avoided. By avoiding or reducing the abrasion between the contacting layers of the heater, the probability of the formation of air gaps or of micro air gaps between these layers, and as a result also the probability of the occurrence of a loss of power that is caused by an inferior heat transmission due to the presence of gaps between the contacting layers, is reduced or even avoided.

The avoidance or reduction of the abrasion between the contacting layers of the heater achieves the effect in particular that the frictional forces between the contacting layers are or remain virtually constant, which leads to an extension of the service life of the heating register according to the invention.

Furthermore, the presence of sliding layers between the contacting layers of the heating register leads to an improvement in the heat transmission in the heating register, which is brought about in particular because the sliding layers that are used have a better thermal conductivity than the micro air gaps.

The heating register of the heating device according to the invention may comprise such an outer layer (outer profile), which at least partially surrounds the arrangement formed by the insulating layers and the layered heating element, respectively makes contact, at least in certain regions, with the surfaces of the insulating layers that are facing away from the heating element, and is braced with the insulating layers and the heating element. The outer layer may be formed as a tube wall of an enveloping tube, preferably of a compressed tube, or as an extrusion profile.

Preferably arranged between at least one of the insulating layers and the outer layer is at least one sliding layer of such a material that the abrasion of the contact surfaces of the insulating layer and of the outer layer respectively goes below a predetermined limit value.

In particular, a material pairing such that the abrasion of the contact surfaces of the insulating layer and of the outer layer respectively goes below a predetermined limit value is used for the forming of at least one insulating layer and the outer layer, at least in the region of their contact surfaces.

The use of suitable material pairings for the forming of the insulating layers and the outer layer of the heating register and/or the presence of suitable sliding layers between the outer layer and the insulating layers has the effect according to the invention of reducing or avoiding abrasion that can be produced between further contacting layers of the heating register according to the invention, which leads to a further reduction in a loss of power that is otherwise caused by the presence of air gaps or micro air gaps.

Furthermore, the layered heating element of the heating device according to the invention may comprise a PTC layer, in particular a PTC layer with at least one electrically conducting contact layer, and two layered contact electrodes, which respectively make contact, at least in certain regions, with a surface of the PTC layer. The layered heating element of the heating device according to the invention may also comprise at least one thick-film heating element applied to a supporting layer.

Preferably arranged between at least one contact electrode and the PTC layer is at least one sliding layer of such a material that the abrasion of the contact surfaces of the contact electrode and of the PTC layer respectively goes below a predetermined limit value.

In particular, a material pairing such that the abrasion of the contact surfaces of the contact electrode and of the PTC layer respectively goes below a predetermined limit value is used for the forming of at least one contact electrode and the PTC layer at least in the region of their contact surfaces.

The use of suitable material pairings for the forming of the contact electrodes and the PTC layer of the heating register and/or the presence of suitable sliding layers between the contact electrodes and the PTC layer has the effect according to the invention of reducing or avoiding abrasion that can be produced between further contacting layers of the heating register according to the invention, which leads to a further reduction in the loss of power that is caused by the presence of air gaps or micro air gaps.

In the case of a particularly preferred embodiment of the invention, the outer layer is formed from aluminum. Furthermore, at least one insulating layer may be formed from insulating ceramic, in particular from an insulating ceramic with alumina. Furthermore, the PTC layer is formed in particular from PTC ceramic. The contact layer of the PTC layer may also be formed from gold, silver or aluminum and at least one contact electrode may be formed from aluminum.

In the case of a further embodiment of the invention, at least one contact electrode and the PTC layer are adhesively bonded to one another at their contact surfaces. The adhesive bonding of contacting layers at their contact surface can also have the effect of drastically reducing the probability of the formation of air gaps or micro air gaps.

In particular, at least one sliding layer that is arranged between at least two of the contacting layers is formed as a coating of a contact surface of one of the at least two contacting layers or as a separate layer. In other words, at least two of the contacting layers may be respectively coated on their contact surface with a sliding layer or comprise a separately formed sliding layer between their contact surfaces.

At least one sliding layer that is present between at least two of the contacting layers is preferably formed as a thin film with a thickness of less than 20 μm from silicone or polyester lacquer with boron nitrite as a lubricant. At least one sliding layer may also be formed from a polymer that is in particular filled with heat conductive particles to realize any level of heat transmission and/or cures by heat or the addition of chemical hardeners.

In particular, at least one sliding layer that is arranged between at least two contacting layers is realized by the introduction of at least one lubricant, such as for example oil or grease, between at least two of the contacting layers. At least one sliding layer may also be formed from a material impregnated with at least one lubricant, such as for example a paper impregnated in oil.

According to the invention, friction-optimized lubricant-free material pairings that do not tend to fret are preferably used for contacting layers, at least in the region of their contact surfaces. In this case, a material pairing of brass and aluminum or of brass and tin is used in particular for the forming of at least two contacting layers, at least in the region of their contact surfaces. The material pairings are in this case chosen in particular in such a way that the coefficient of friction between the contacting layers is reduced. For example, the material pairing of aluminum with aluminum has a coefficient of friction of 1.

In simple terms, according to the invention the abrasion between the layers of a heating register is minimized by the selection of the materials from which the layers are formed and/or by the use of additional measures, such as a suitable coating of the layers and/or the insertion of intermediate layers of suitable material between the layers.

Minimizing the abrasion between the materials of the contacting layers of the heating register, which have different thermal expansions, has the effect of minimizing or avoiding the formation of micro gaps between these layers, such as for example between a PTC ceramic and the contact sheets and/or between an insulating ceramic and an enveloping tube or profile. As a result, a loss of power in the heating register according to the invention that is brought about by the presence of micro gaps is also avoided.

The way in which the heating device is constructed according to the invention is particularly suitable for high voltages, that is to say for voltages that are greater than 60 V. However, the construction according to the invention is also suitable for electrical auxiliary heaters with a voltage <60 V. The use of modified material pairings and/or the use of a sliding layer between contacting layers does not impair the function or the area of use of the electric heater according to the invention. That is to say that the use of the modified material pairings and/or the use of a sliding layer between the contacting layers does not cause any appreciable loss of power or any impairment of the electrical insulating resistance with regard to high voltages.

BRIEF DESCRIPTION OF THE DRAWINGS

The invention is explained in more detail below on the basis of at least one exemplary embodiment with reference to the drawings, in which.

PREFERRED EMBODIMENTS OF THE INVENTION

Figure 1:
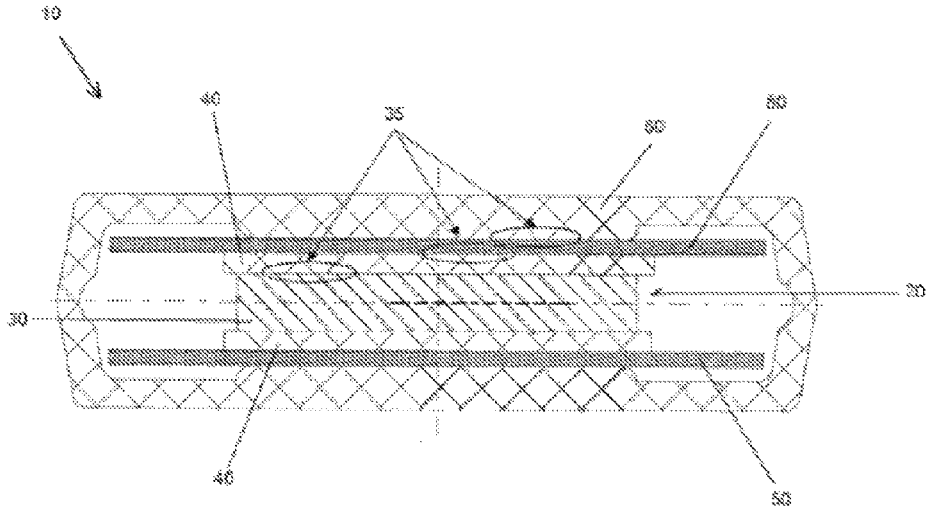
Fig. 1 Prior art
FIG. 1 shows a cross-sectional view of a heating register of an electrically operated heating device according to the prior art.
Figure 2:
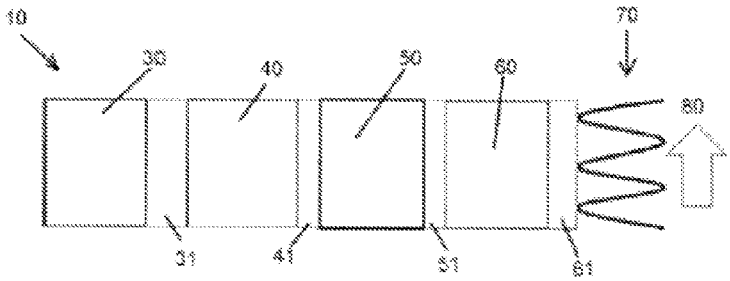
Fig. 2 Prior art
FIG. 2 shows a greatly schematized partial cross-sectional view through the heating register represented in FIG. 1, the heating register being represented in an initial state, which directly follows the production of the associated heating device.
Figure 3:
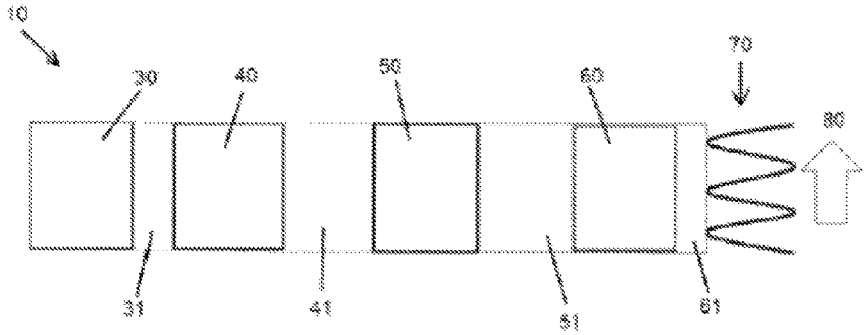
Fig. 3 Prior art
FIG. 3 shows a greatly schematized partial cross-sectional view through the heating register represented in FIG. 1, the heating register being represented in a state that exists after it has gone through a number of thermal cycles.
Figure 4:
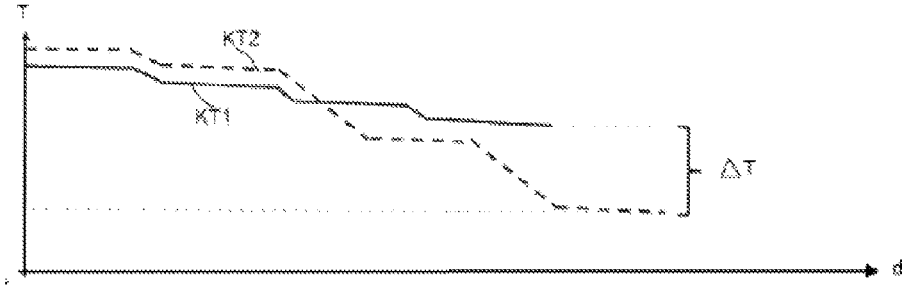
Fig. 4 Prior art
FIG. 4 shows the variation in temperature through the heating register in the state represented in FIG. 3 in comparison with the variation in temperature through the heating register in the state represented in FIG. 4.
Figure 5:
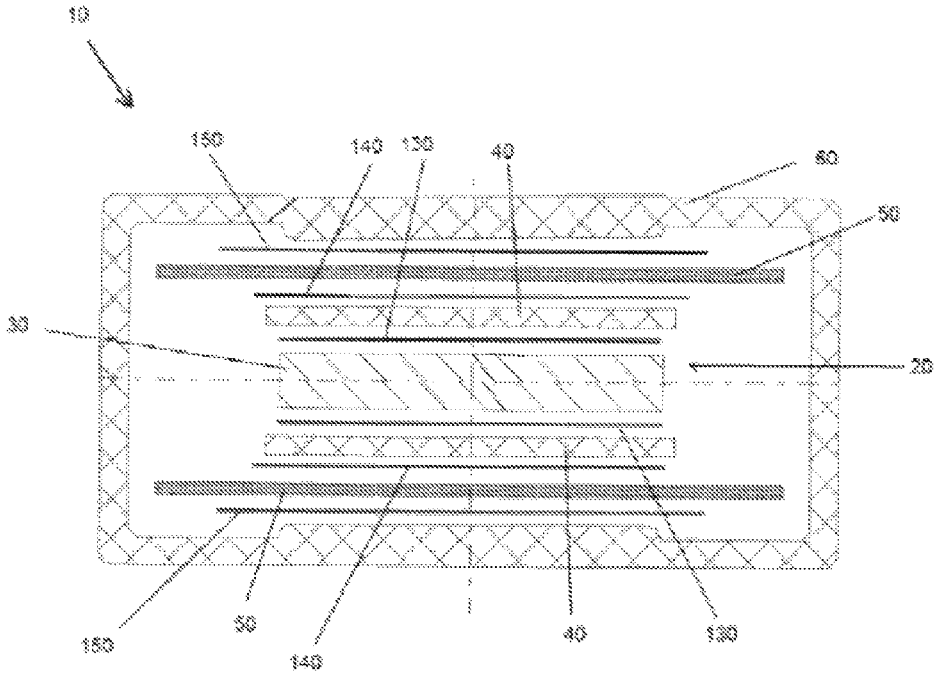
FIG. 5 shows a cross-sectional view of a heating register of an electrically operated heating device according to a first embodiment of the invention.

FIG. 5 shows in an exploded representation a cross-sectional view through a heating register 10 of a heating device according to a first exemplary embodiment of the heating device according to the invention. The heating register 10 of the heating device according to the first embodiment comprises a layered heating element 20, which comprises a PTC layer 30 and two layered contact electrodes 40. The PTC layer 30 is arranged between the two contact electrodes 40. Respectively arranged between each of the contact electrodes 40 and the PTC layer 30 is a separately formed sliding layer 130, by means of which the abrasion between the corresponding contact electrode 40 and the PTC layer 30 is minimized or avoided.

In the case of each of the contact electrodes 40, an insulating layer 50 is arranged on the respective side facing away from the PTC layer 30. Furthermore, arranged between each contact electrode 40 and each insulating layer 50 there is also a separately formed sliding layer 140, by means of which the abrasion between the corresponding contact electrode 40 and the corresponding insulating layer 50 is minimized or avoided.

Also present on the side of a respective insulating layer 50 that is facing away from a contact electrode 40 is a tube profile 60, which is formed as an enveloping compressed tube 60. By means of this compressed tube 60, all of the elements forming the heating register 10 are braced with one another. In this case, a good heat transfer from the heating element 20 to the outer heat-transmitting surface of the compressed tube 60 is ensured by the applied pressing force. Furthermore, arranged between each insulating layer 50 and the compressed tube 60 there is also a separately formed sliding layer 150, by means of which abrasion between the compressed tube 60 and the corresponding insulating layer 50 is minimized or avoided.

Figure 6:
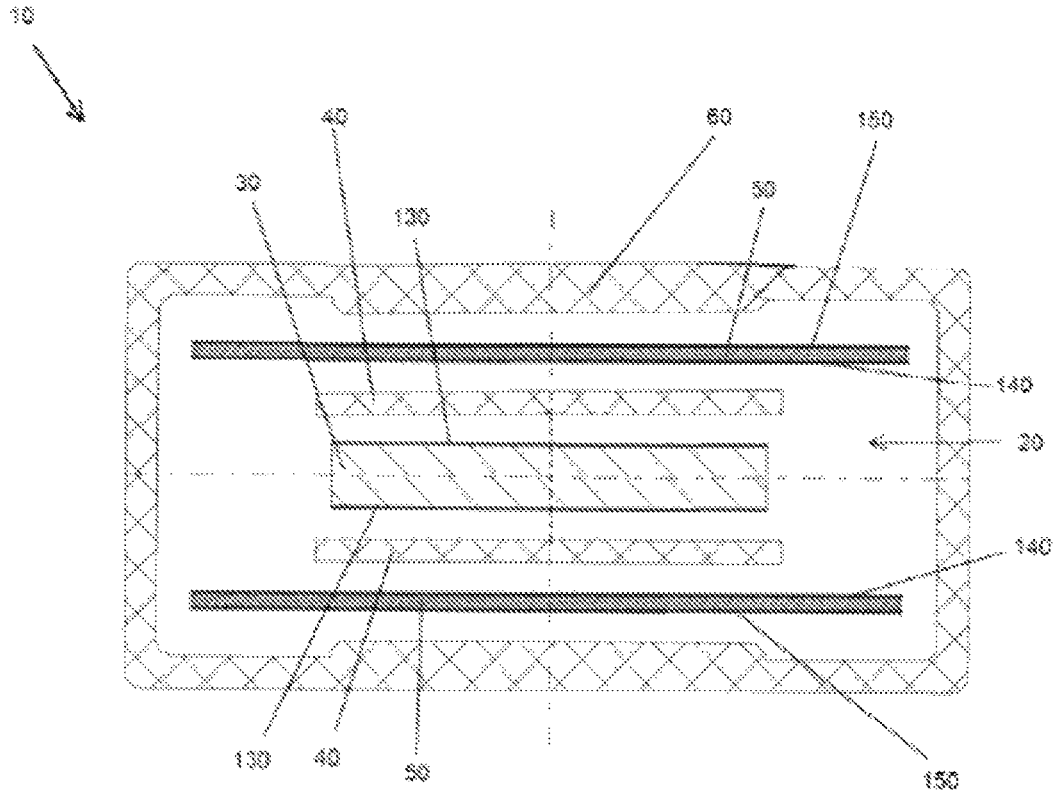
FIG. 6 shows a cross-sectional view of a heating register of an electrically operated heating device according to a second embodiment of the invention.

FIG. 6 shows in an exploded representation a cross-sectional view through a heating register 10 of a heating device according to a second exemplary embodiment of the heating device according to the invention. The heating register 10 of the heating device according to the second embodiment comprises a layered heating element 20, which comprises a PTC layer 30 arranged between two layered contact electrodes 40.

The PTC layer 30 is coated on each side facing a corresponding contact electrode with a sliding layer 130, by means of which the abrasion between the PTC layer 30 and the corresponding contact electrode 40 is minimized or avoided.

On the side of each contact electrode 40 that is facing away from the PTC layer 30, an insulating layer 50 is respectively arranged. Each insulating layer 50 is coated on its side facing the corresponding contact electrode 40 with a sliding layer 140, by means of which the abrasion between each of the insulating layers 50 and the corresponding contact electrode 40 is minimized or avoided.

Also present on the side of each insulating layer that is facing away from a contact electrode 40 is a tube profile 60, which is formed as an enveloping compressed tube 60. In the case of this exemplary embodiment too, by means of the compressed tube 60, all of the elements forming the heating register 10 are braced with one another. Here, too, a good heat transfer from the heating element 20 to the outer heat-transmitting surface of the compressed tube 60 is ensured by the pressing force. Furthermore, each insulating layer 50 is coated on its side facing the enveloping tube 60 with a sliding layer 150, by means of which the abrasion between each of the insulating layers 50 and the enveloping tube 60 is minimized or avoided.

Both in the case of the first exemplary embodiment and in the case of the second exemplary embodiment of the invention, the PTC layer 30 may comprise a PTC ceramic layer and have at least one conducting contact layer (not represented) of gold or silver. Furthermore, each of the insulating layers 50 may be formed from insulating ceramic. The enveloping tube 60 may be formed in particular from aluminum.

In this way, according to the invention at least one of the sliding layers 130, 140, 150 may be introduced as a further component between the surfaces of the corresponding contacting layers of the heating register 10 that move in relation to one another.

Furthermore, at least one of the sliding layers 130, 140, 150 may be respectively formed as a direct coating of one or both of the surfaces of at least two of the contacting or mutually adjacent layers of the heating register 10 that move in relation to one another.

A lubricant, such as for example oil or grease, may also be introduced between the surfaces of at least two of the contacting layers that move in relation to one another.

Furthermore, the sliding layer system according to the invention may comprise a combination of a number of the aforementioned sliding layers. For example, one of the two surfaces that move in relation to one another is respectively coated, it also being possible for lubricant, such as for example oil, or a paper impregnated with lubricant, to be introduced between the surfaces.

On at least one of the layers of the heating register 10, in particular on at least one of the insulating layers 50, that is preferably formed from insulating ceramic there may also be a corresponding sliding layer 130, 140, 150 of a material mixture, it being possible for the material mixture to comprise silicone or polyester lacquer with boron nitrite as a lubricant and it being designed for thin-film applications below 20 μm, preferably below 5 μm, preferably on insulating ceramic.

Furthermore, at least one sliding layer 130, 140, 150 may comprise a polymer as a heat conductor medium that is filled with heat particles. This polymer may cure by heat or by the addition of chemical hardeners. The heat transmission then takes place exclusively by way of the heat particles. In this case, the degree of filling of such polymers with heat particles is at least 60%.

The invention claimed is:

1. An electrically operated heating device comprising:

a heating register, a layered heating element, for converting electrical energy into heat, and at least one electrically insulating and heat-conducting insulating layer, which makes contact, at least in certain regions, with one side of the layered heating element, the insulating layer and the layered heating element being braced with one another, wherein at least one abrasion-counteracting sliding layer is arranged between at least one insulating layer and the layered heating element or wherein at least one insulating layer and the layered heating element have, at least in the region of their mutual contact surfaces, a material pairing with which the abrasion of the contact surfaces goes below a predetermined limit value, wherein the at least one sliding layer or the material pairing has a thickness of less than 20 μm and is formed from a material consisting essentially of silicone or polyester lacquer with boron nitrite as a lubricant or from a polymer that is filled with heat conductive particles.

2. The electrically operated heating device according to claim 1, wherein the heating register comprises an outer layer, which at least partially surrounds the arrangement formed by the insulating layer or the insulating layers and the layered heating element, contact being made by the outer layer, at least in certain regions, with the surfaces of the insulating layer that are facing away from the heating element, and the outer layer being braced with the insulating layer and the heating element and being formed as a tube wall of an enveloping, preferably compressed tube or as an extrusion profile.

3. The electrically operated heating device according to claim 1, wherein the layered heating element is a PTC layer, which is provided with at least one electrically conducting contact layer, and comprises two layered contact electrodes, which respectively make contact, at least in certain regions, with a surface of the PTC layer, or in that the layered heating element comprises at least one thick-film heating element applied to a supporting layer.

4. The electrically operated heating device according to claim 3, wherein the at least one abrasion-counteracting sliding layer is arranged between at least one of the contact electrodes and the PTC layer or between at least one of the insulating layers and the outer layer or wherein at least one of the contact electrodes and the PTC layer or at least one insulating layer and the outer layer have, at least in the region of their mutual contact surfaces, a material pairing with which the abrasion of the contact surfaces goes below a predetermined limit value.

5. The electrically operated heating device according to claim 1, wherein the outer layer is formed from aluminum or at least one of the insulating layers is formed with an insulating ceramic or the PTC layer is formed from PTC ceramic or the contact layer of the PTC layer is formed from gold or silver or at least one contact electrode is formed from aluminum.

6. The electrically operated heating device according to claim 1, wherein at least one contact electrode is adhesively bonded at its contact surfaces to the PTC layer.

7. The electrically operated heating device according to claim 1, wherein at least one of the at least one sliding layer that is arranged between two contacting layers is formed as a coating of a contact surface of one of the two contacting layers or as a separate layer.

8. The electrically operated heating device according to claim 1, wherein at least one of the at least one sliding layer that is arranged between two of the contacting layers is realized by the introduction of a lubricant, such as for example oil or grease, between the at least two contacting layers or is formed from a material impregnated with a lubricant, such as for example a paper impregnated in oil.

9. The electrically operated heating device according to claim 1, wherein at least two of the contacting layers have, at least in the region of their mutual contact surfaces, a material pairing of brass and aluminum or of brass and tin.

* * * * *